US009604343B2

(12) United States Patent
Oksanen

(10) Patent No.: US 9,604,343 B2
(45) Date of Patent: Mar. 28, 2017

(54) HYDRO-FILTRATION UNIT WITH SANDING HEADS

(71) Applicant: Daniel Oksanen, Dumfries, VA (US)

(72) Inventor: Daniel Oksanen, Dumfries, VA (US)

(73) Assignee: Daniel P Oksanen, Dumfries, VA (US)

( * ) Notice: Subject to any disclaimer, the term of this patent is extended or adjusted under 35 U.S.C. 154(b) by 0 days.

(21) Appl. No.: 14/860,446

(22) Filed: Sep. 21, 2015

(65) Prior Publication Data

US 2016/0082381 A1 Mar. 24, 2016

Related U.S. Application Data

(60) Provisional application No. 62/052,867, filed on Sep. 19, 2014.

(51) Int. Cl.
*B24B 55/00* (2006.01)
*B24B 55/06* (2006.01)

(52) U.S. Cl.
CPC ..... *B24B 55/06* (2013.01)

(58) Field of Classification Search
CPC .. B24B 55/06; A47L 9/18; A47L 9/181–9/183
USPC ..... 451/259, 456, 354; 96/359, 329–354; 95/226; 15/353
See application file for complete search history.

(56) References Cited

U.S. PATENT DOCUMENTS 4,251,241 A * 2/1981 Bothun ..... A47L 7/0019 15/353
4,937,984 A * 7/1990 Taranto ..... B24D 15/023 451/354
4,993,107 A * 2/1991 Zoni ..... E01H 1/0827 15/347
5,297,363 A * 3/1994 Schroder ..... B08B 7/024 451/354
5,428,865 A 7/1995 Yarbrough
5,605,500 A * 2/1997 Matechuk ..... B24B 55/10 451/344
5,624,305 A * 4/1997 Brown ..... B24B 55/06 16/337
5,873,930 A * 2/1999 Sanchez ..... A47L 9/181 55/445
6,083,307 A * 7/2000 Dular ..... B01D 47/021 15/353
6,315,647 B1 * 11/2001 Ghilardi ..... B24B 23/02 451/344
6,524,173 B1 * 2/2003 Nelson ..... A47L 9/02 451/178
6,616,733 B1 * 9/2003 Pellegrin ..... B01D 47/04 95/150

(Continued)

*Primary Examiner* — George Nguyen

(57) ABSTRACT

A motor, a reservoir, a recovery basket, an internal hose, an external hose, a power switch, baffle with injection nozzles and floats, a sanding head, an extended sanding head, and a corner sanding head comprises a hydro-filtration unit with a sanding heads for drywall work. The sanding heads may be used to sand drywall and simultaneously draw the dust out of the air as it is created through the sanding process. The hydro-filtration prevents dust from being released into the air. Within the reservoir, the internal hose connects at one end to the motor and at the other to the floating dust injector unit and the injection nozzles. The external hose connects the sanding heads to the motor.

18 Claims, 5 Drawing Sheets

(56) References Cited

U.S. PATENT DOCUMENTS

| | | | | |
|---|---|---|---|---|
| 6,866,705 | B2 * | 3/2005 | Nielsen | A47L 9/102 15/353 |
| 7,370,389 | B2 | 5/2008 | Tsen | |
| 7,824,456 | B1 * | 11/2010 | Monson | A47L 11/34 15/347 |
| 9,237,835 | B2 * | 1/2016 | Amoretti | A47L 5/225 |
| 2005/0071947 | A1 * | 4/2005 | Yarbrough | A47L 9/181 15/353 |
| 2012/0145009 | A1 | 6/2012 | Kim | |

* cited by examiner

HYDRO-FILTRATION UNIT WITH SANDING HEADS

CROSS-REFERENCE TO RELATED APPLICATIONS

This Application claims the benefit of U.S. Provisional Application No. 62/052,867, filed Sep. 19, 2014, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to construction and remodeling accessories, and in particular to a hydro-filtration unit with sanding heads for drywall work. When workers are installing drywall, the paste or "mud" used to fill gaps between drywall panels must be sanded down to provide a smooth, even surface for painting. The process of sanding creates an enormous amount of airborne dust, requiring the workers to wear protective face masks and creating a huge mess. The clean-up tasks after drywall installation can be monumental, and include cleaning out the air ducts of the building's heating system. Even the clean-up process continues to release dust back into the air, and turns into a long, expensive, and labor-intensive chore. A hydro-filtration unit with sanding heads for drywall work, which draws dust out of the air as it is created and injects the dust into water, creates a mixture of dust and water, preventing the dust from being released into the air and would resolve this problem.

SUMMARY OF THE INVENTION

Accordingly, the invention is directed to a hydro-filtration unit with sanding heads for drywall work. The hydro-filtration unit with sanding heads is comprised of a reservoir, a recovery basket, a motor, injection nozzles attached to a baffle, an internal hose, an external hose, a power switch, a sanding head, an extended sanding head, and a corner sanding head. The sanding heads may be used to sand down the joints between drywall panels. The motor of the hydro-filtration unit draws the dust out of the air as it is created through apertures in the sanding heads. The reservoir is filled with water for the purpose of creating a water and dust solution. Trapping the dust in the water prevents dust from being released into the air. The recovery basket is placed within the reservoir and is removable so that the water dust solution can be collected. The injection nozzles float on the top of the water and are connected to the motor by the internal hose. The internal hose connects to the output of the vacuum motor. The external hose connects the sanding heads and the vacuum motor intake. While operating, each sanding head creates dust which is drawn into the external hose. The dust travels through the internal hose and is injected into the water to create the water and dust solution, trapping dust and preventing it from being released.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
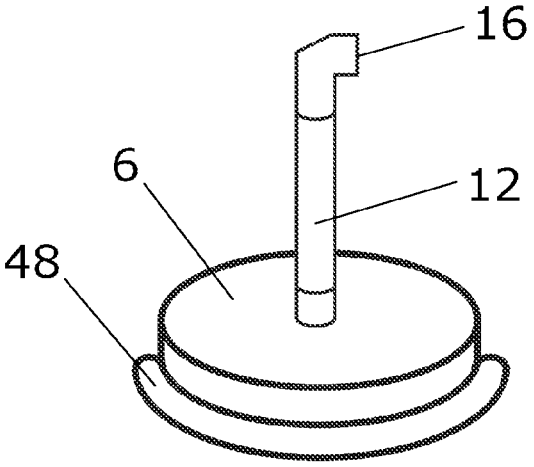
FIG. 1 is a front view of the floating dust injector unit, displaying the baffles 6, floats 14, interior hose 12, and connection to the motor 16.
Figure 2:
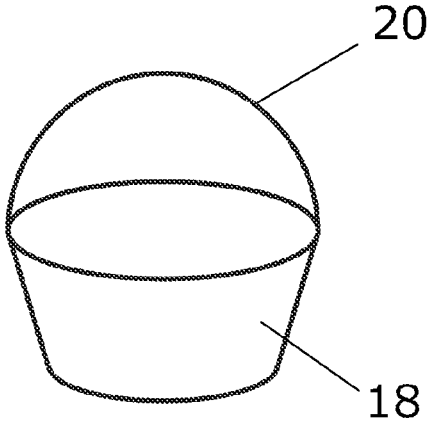
FIG. 2 is a front view of the recovery basket, displaying the body of the basket 18 and handle 20.
Figure 3:
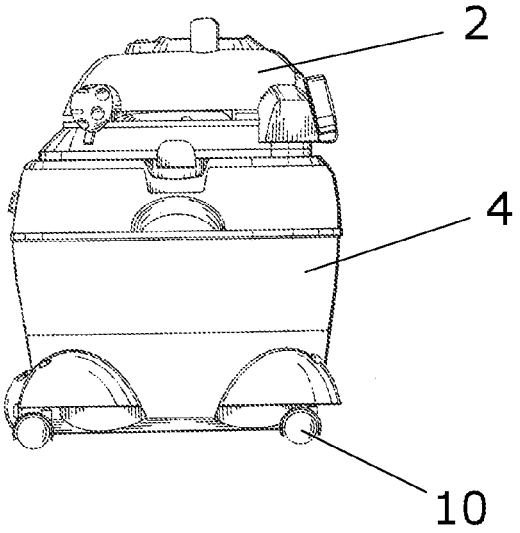
FIG. 3 is a front view of the hydro-filtration unit, displaying the motor 2, reservoir 4, and caster wheels 10.
Figure 4:
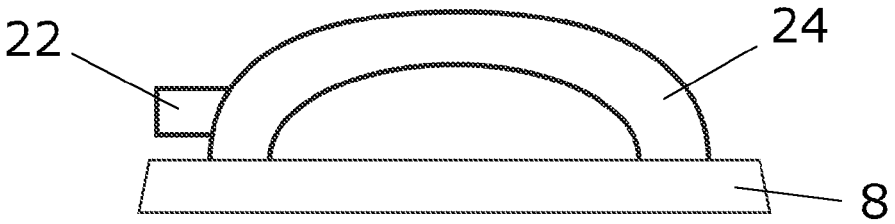
FIG. 4 is a front view of the sanding head, displaying the sanding surface 8, the curved handle 24, and the attachment point 22.
Figure 5:
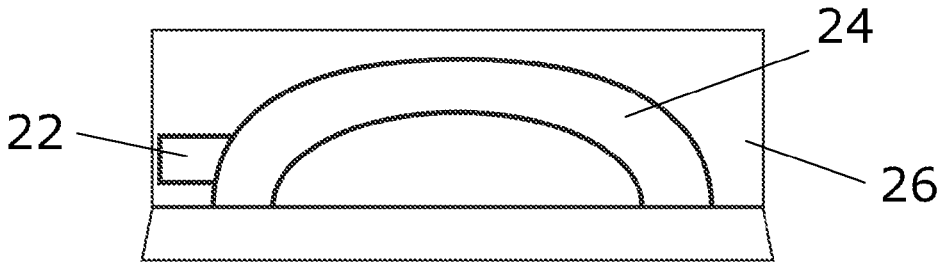
FIG. 5 is a front view of the corner sanding head, displaying the sanding surfaces 26, the curved handle 24, and the attachment point 22.
Figure 6:
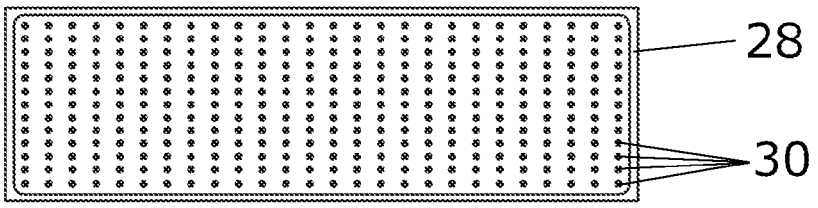
FIG. 6 is a bottom view of the sanding pad, displaying the apertures 30 and the side intake 28.
Figure 7:
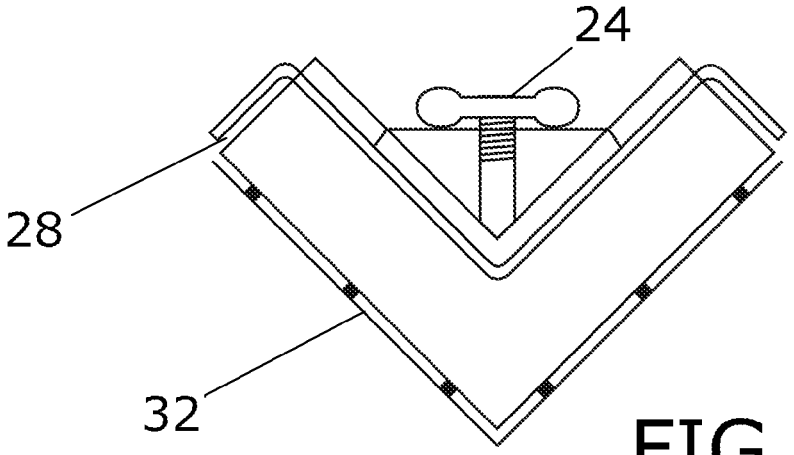
FIG. 7 is a side view of the corner sanding head, displaying the sanding surfaces 32, the side intake 28, and the handle 24.
Figure 8:
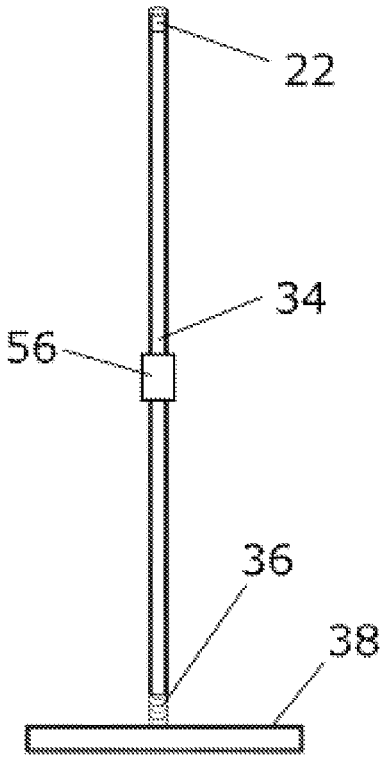
FIG. 8 is a front view of the extended sanding head, displaying the sanding surface 38, the extendable handle 34, the extension point 56, the pivot point 36, and the exterior hose attachment point 22.
Figure 9:
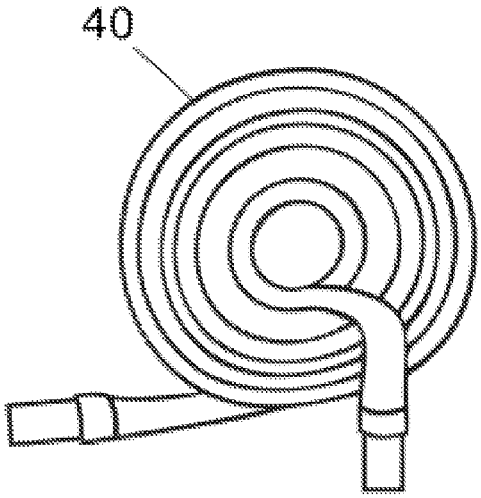
FIG. 9 is a front view of the exterior hose 40.
Figure 10:
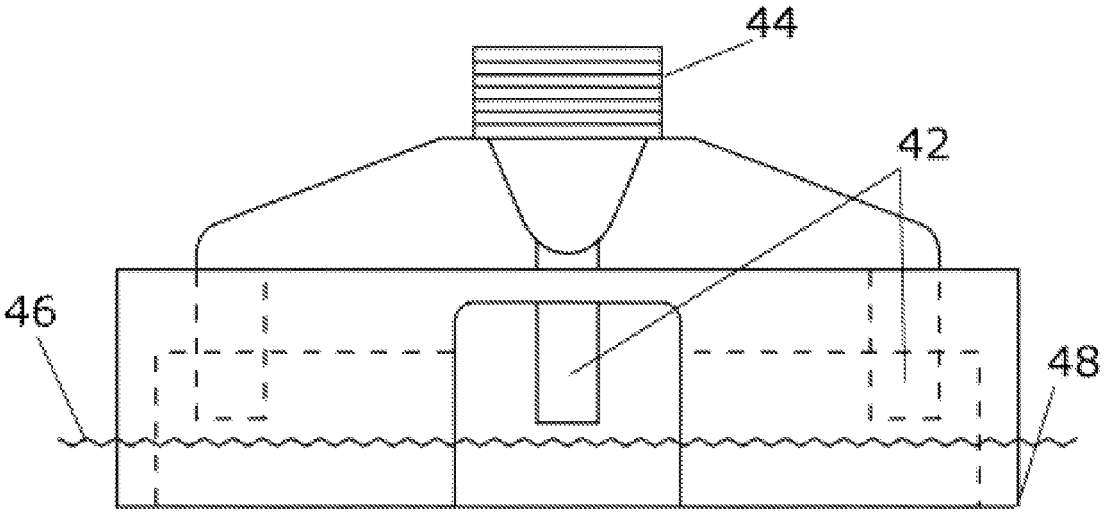
FIG. 10 is a detailed front view of the floating dust injector unit, displaying the dust injector nozzles 42, the interior hose attachment point 44, the water level 46, and the floats 48.
Figure 11:
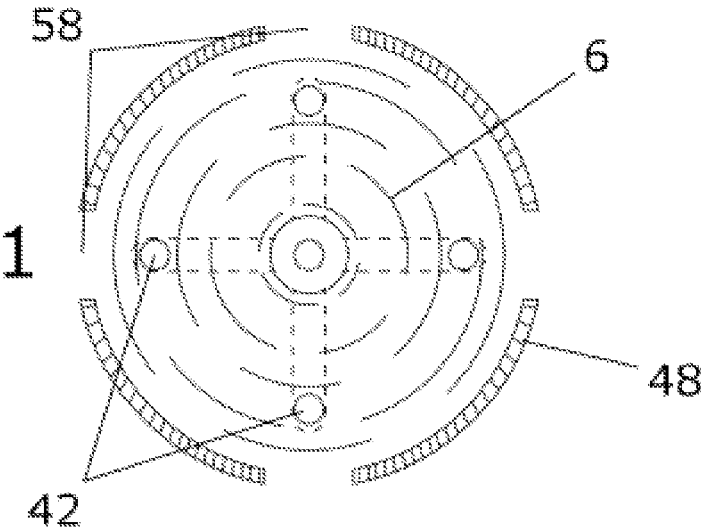
FIG. 11 is a detailed bottom view of the floating dust injector unit, displaying the baffles 6, dust injector nozzles 42, the floats 48, and the air releases 58.
Figure 12:
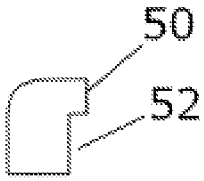
FIG. 12 is a section side view of the sanding head, displaying the elevated edge 50 and the seat 52 for the sanding pad.
Figure 13:
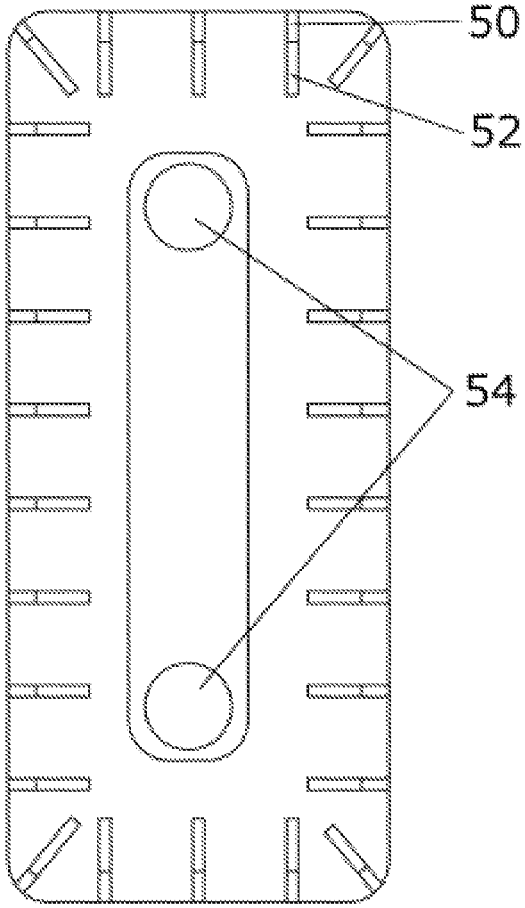
FIG. 13 is a detailed bottom view of the sanding head without the sanding pad, displaying the elevated edge 50, the seat 52 for the sanding pad, and the openings 54 into the handle.
Figure 14:
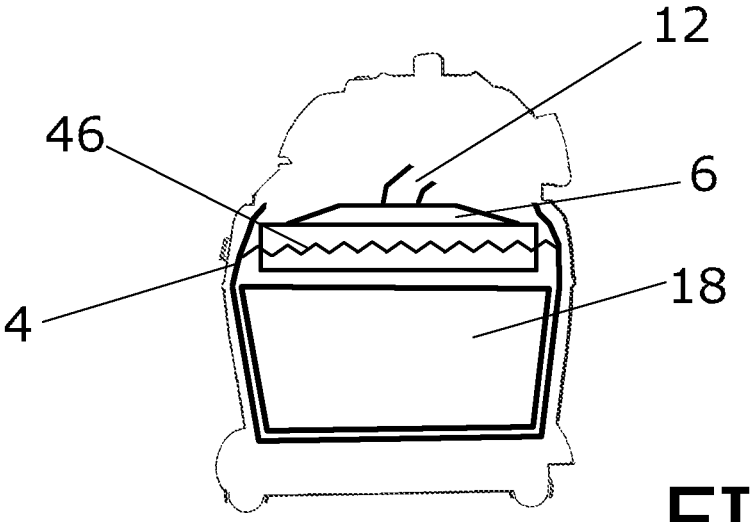
FIG. 14 is a front sectional view of the hydro-filtration unit, reservoir 4 and the recovery basket 18.

Referring now to the invention in more detail, the invention is directed to a hydro-filtration unit with sanding heads for drywall work.

The first exemplary embodiment is comprised of a motor 2, a reservoir 4, a recovery basket 18 with handle 20, injection nozzles 42 attached to a baffle 6 with floats 48, an internal hose 12 with connection point to motor 16, an external hose 40, a power switch, a sanding head, an extended sanding head, and a corner sanding head.

The reservoir 4 is preferably mounted on a plurality of caster wheels 10, preferably four caster wheels 10. The reservoir 4 is partially filled with water 46 for the purpose of creating a water and dust solution. The recovery basket 18 is placed inside the reservoir to collect the water dust solution. The motor 2 is removable and mounted to the top of the reservoir 4 and secured with one or more latches. Within the reservoir 4, the interior hose 12 stretches from the motor 2 to the floating dust injector unit which uses the floats 48 to remain on top of the water 46. The space between the floats 48 are air releases 58 which allow excess air from the injector nozzles 42 to escape from the floating dust injector. The exterior hose 40 connects to the motor on one end and the sanding heads on the other. The external hose 40 connects to an attachment point 22 on each sanding head, and draws air and dust to the motor 2.

While operating, each sanding head creates dust which is drawn through the apertures 30 and/or side intakes 28 of the sanding surface. The dust is then drawn through an opening in the surface 54 which connects into the external hose 40. The dust travels through the external hose to the motor 2 intake and is then blown into the internal hose 12. The dust then travels through the internal hose 12 and is injected into the water 46 in the reservoir 4 through the injector nozzles 42 to create the water and dust solution. This process traps dust in the water and prevents it from being released into the air.

The motor 2 is preferably powered by standard household current, and provides a power cord which may be plugged into any standard three-pronged wall outlet. The corner sanding head provides two sanding surfaces 26 at right angles to each other, and a curved handle 24. The extended sanding head provides an extended handle 34 with an extension point 56, which is preferably at least three feet in length and may be segmented for easy storage and transport. The lower end of the extended handle 34 is affixed to the sanding head 38 via a ball joint 36, while the upper end provides the attachment point 22.

The recovery basket 18 is porous, allowing water to circulate while trapping dust in the form of a sediment at the bottom of the water and dust solution. The sediment may be recycled by the user as fresh "mud." The recovery basket 18 preferably has a handle 20 for easy removal from the reservoir 4.

To use the first exemplary embodiment, the user may remove the motor 2 from the reservoir 4 and partially fill the reservoir 4 with water 46, then replace and affix the motor 2. The user may then attach one end of the external hose 40 to the motor 2, and the other end of the external hose 40 to the attachment point 22 of the desired sanding head. The user may then activate the power switch and begin sanding.

The recovery basket 18, the motor 2, the reservoir 4, the caster wheels 10, the corner sanding head, the curved handle 24, the extended sanding head, the extended handle 34, and the ball joint 36 are preferably manufactured from rigid, durable materials which are corrosion resistant, such as stainless steel, plastic, and aluminum alloy. The external hose 40 and the internal hose 12 are preferably manufactured from flexible, durable materials, such as rubber, silicone, and plastic. The power cord and the auxiliary power cord are preferably manufactured from braided copper alloy wire sheathed in plastic. Components and methods listed above are preferable, but artisans will recognize that alternate components and methods could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A hydro-filtration unit, comprising:

(a) a motor;

(b) said motor powering a vacuum pump;

(c) a reservoir;

(d) said reservoir being partially filled with water;

(e) a recovery basket;

(f) said recovery basket being of a size and shape to fit inside said reservoir;

(g) a floating particle injector unit having a baffle, an interior hose attachment, a plurality of injection nozzles, and floats;

(h) an internal hose;

(i) said internal hose being configured to connect on one end to said vacuum pump and to connect on an opposite end to said interior hose attachment;

(j) said floating particle injector being configured to float on top of said water;

(k) an external hose;

(l) said external hose being configured to connect on one end to said vacuum pump;

wherein said hydro-filtration unit is configured such that said vacuum pump draws particles and air through said external hose and propels particles and air through said internal hose and out said floating particle injector and into said water where particles accumulate in said recovery basket.

2. The hydro-filtration unit of claim 1, further comprising:

(a) a sanding head having an attachment point, a hollow handle, a sanding surface, a side intake, and a surface opening;

(b) said surface opening being an aperture through the sanding surface;

(c) said hollow handle being attached to said sanding head at said surface opening and configured to allow the passing of air and particles through said surface opening into said hollow handle;

(d) said attachment point being connected to said hollow handle and configured to allow the passing of air and particle from said surface opening through said hollow handle and out said attachment point;

(e) a sanding pad having a plurality of apertures;

(f) said sanding pad being affixed to said sanding surface;

wherein said hydro-filtration unit with sanding heads is configured such that said vacuum pump draws particles and air through said plurality of apertures in said sanding pad or said side intake, through said surface opening, through said hollow handle, through said attachment point, through said external hose and propels particles and air through said internal hose and out said floating particle injector and into said water where particles accumulate in said recovery basket.

3. The hydro-filtration unit with sanding heads of claim 2, wherein said sanding surface comprises a single sanding surface; said handle connecting to said single sanding surface at two points; said surface opening being equal to two in number and located where said handle connects to said single sanding surface.

4. The hydro-filtration unit with sanding heads of claim 2, wherein said sanding head comprises two sanding surfaces; said two sanding surfaces being perpendicular to each other creating a ninety-degree angle; said handle connecting to said sanding surface at two points.

5. The hydro-filtration unit with sanding heads of claim 2, wherein said sanding head comprises a single sanding surface; said handle connecting to said single sanding surface at one point via a pivot point; said handle being extendable; said surface opening being located where said pivot points connects to said single sanding surface.

6. The hydro-filtration unit with sanding heads of claim 3, wherein said sanding surface further comprises an elevated edge and a seat for said sanding pad; said elevated edge surrounding said seat for said sanding pad.

7. The hydro-filtration unit with sanding heads of claim 4, wherein said sanding surface further comprises an elevated edge and a seat for said sanding pad; said elevated edge surrounding said seat for said sanding pad.

8. The hydro-filtration unit with sanding heads of claim 5, wherein said sanding surface further comprises an elevated edge and a seat for said sanding pad; said elevated edge surrounding said seat for said sanding pad.

9. The hydro-filtration unit of claim 1, wherein said reservoir is mounted on a plurality of caster wheels.

10. The hydro-filtration unit with sanding heads of claim 2, wherein said reservoir is mounted on a plurality of caster wheels.

11. The hydro-filtration unit of claim 9, wherein said plurality of caster wheels equals four in number.

12. The hydro-filtration unit with sanding heads of claim 10, wherein said plurality of caster wheels equals four in number.

13. The hydro-filtration unit of claim 1, wherein said motor is mounted to said reservoir with a plurality of latches.

14. The hydro-filtration unit with sanding heads of claim 2, wherein said motor is mounted to said reservoir with a plurality of latches.

15. The hydro-filtration unit with sanding heads of claim 5, wherein said pivot point is a ball joint.

16. The hydro-filtration unit with sanding heads of claim 8, wherein said pivot point is a ball joint.

17. The hydro-filtration unit of claim 1, wherein said floating dust injector further comprises air releases; said air releases being configured to allow air from said injector nozzles to escape from beneath said floating dust injector.

18. The hydro-filtration unit with sanding heads of claim 2, wherein said floating dust injector further comprises air releases; said air releases being configured to allow air from said injector nozzles to escape from beneath said floating dust injector.

* * * * *